United States Patent [19]

Krob et al.

[11] Patent Number: 4,589,674

[45] Date of Patent: May 20, 1986

[54] APPARATUS FOR FACILITATING A LONGITUDINAL ADJUSTMENT OF SKI-BINDING PARTS

[75] Inventors: Erwin Krob; Helmut Bauer, both of Vienna, Austria

[73] Assignee: TMC Corporation, Baar, Switzerland

[21] Appl. No.: 748,386

[22] Filed: Jun. 25, 1985

Related U.S. Application Data

[63] Continuation of Ser. No. 380,850, May 21, 1982, abandoned.

[30] Foreign Application Priority Data

Jun. 12, 1981 [AT] Austria ..... 2621/81

[51] Int. Cl.[4] ..... A63C 9/00

[52] U.S. Cl. ..... 280/633

[58] Field of Search ..... 280/633, 636, 607; 24/68 SK, 68 H, 70 SK, 71 SK, 201 C, 205 R

[56] References Cited

U.S. PATENT DOCUMENTS

| | | | |
|---|---|---|---|
| 2,802,248 | 8/1957 | Wallace | 24/68 B |
| 3,531,135 | 9/1970 | Salomon | 280/633 |
| 3,913,931 | 10/1975 | Kratky | 280/623 |
| 3,989,274 | 11/1976 | Weigl et al. | 280/634 |
| 4,157,193 | 6/1979 | Beyl | 280/633 |

FOREIGN PATENT DOCUMENTS

| | | | |
|---|---|---|---|
| 276180 | 11/1969 | Austria . | |
| 338674 | 9/1977 | Austria . | |
| 3015478 | 6/1980 | Fed. Rep. of Germany . | |
| 2451756 | 11/1980 | France | 280/633 |
| 480848 | 12/1969 | Switzerland | 280/633 |
| 556674 | 12/1974 | Switzerland . | |

*Primary Examiner*—John J. Love
*Assistant Examiner*—Joseph G. McCarthy
*Attorney, Agent, or Firm*—Flynn, Thiel, Boutell & Tanis

[57] ABSTRACT

An apparatus for facilitating a longitudinal adjustment of ski-binding parts having a guide rail adapted to be fastened to a ski and which is provided with two laterally spaced guide tracks. Toothed bars are provided and are arranged between the guide tracks and extend in the longitudinal direction of the apparatus. The toothed bars have associated with them a toothed locking member which is arranged on a slide plate and the slide plate is covered by a guide plate which is supported on the guide rail. The guide plate is adapted to have a ski-binding part mounted thereon. Between shoulders provided on the two plates there is arranged at least one compression spring which urges the guide plate toward the ski boot. The guide plate in the region of its end remote from the ski boot has two downwardly extending projections. The slide plate, which is pivotally supported on the guide plate is movable relative thereto has two shoulders at its end which is adjacent to the toothed locking member, which shoulders rest in the released position of the apparatus on the projections of the guide plate under the bias provided by the compression spring.

15 Claims, 7 Drawing Figures

APPARATUS FOR FACILITATING A LONGITUDINAL ADJUSTMENT OF SKI-BINDING PARTS

This is a continuation of application Ser. No. 380,850, filed May 21, 1982; now abandoned.

FIELD OF THE INVENTION

The invention relates to an apparatus for facilitating a longitudinal adjustment of ski-binding parts, comprising a guide rail which is adapted to be secured to the ski and which is provided with two laterally spaced guide tracks and with toothed bars which are arranged between said guide tracks and which extend in the longitudinal direction of the apparatus, wherein a toothed locking member which is arranged on a slide plate is associated with the toothed bars and the slide plate is covered by a guide plate which is supported on the guide rail, which guide plate has a ski-binding part mounted thereon, and wherein between shoulders of the two plates there is arranged at least one compression spring for continually urging the guide plate toward the ski boot.

BACKGROUND OF THE INVENTION

The conventional apparatus of this type has the disadvantage that for their adjustment, two hands are always needed.

An object of the invention is to overcome this disadvantage and to provide an apparatus for enabling a longitudinal adjustment of ski-binding parts of the above disclosed type, wherein the ski-binding part can be unlocked with one hand, can be adjusted in the longitudinal direction of the ski and can again be locked in the desired position.

The object is inventively achieved primarily by a guide plate having in the region of its end remote from the ski boot downwardly extending projections, and by a slide plate, which is pivotally supported on the guide plate and is movable relative thereto, has two shoulders thereon at its end which is adjacent to a toothed locking member, which shoulders in the released position of the apparatus rest on the projections of the guide plate under the bias provided by at least one compression spring. Thus, as soon as the lock provided by the slide plate is released, same is held on the guide plate, for example, by a frictional contact, and the ski-binding part which is secured to the guide plate can be moved along the guide rail. When the desired position is reached, a pressing down on the slide plate is sufficient in order to again lock same with respect to the guide rail.

According to a further characteristic of the invention, the slide plate has an upwardly bent portion with at least one hole therein for its movable support on the guide plate, into which hole is movably supported at least one rod anchored on the guide plate and on which is sleevably mounted a compression spring. In this manner a certain movement between the slide plate and the guide plate is made possible during the adjusting operation and, at the same time, the risk of a separation of the two plates is reliably prevented.

According to a different characteristic of the invention, the slide plate has for its pivotal support on the guide plate at its end which is remote from the toothed locking member two further laterally spaced shoulders, which grip behind downwardly extending projections on the guide plate. This jointed connection between the guide plate and the slide plate makes it possible, in a particularly simple manner, on the one hand to achieve an upward swinging of the slide plate during the adjusting operation and on the other hand a movement of the same relative to the guide plate.

The movement of the free end of the slide plate in a vertical direction during the adjusting operation can, of course, be carried out in various ways. For example, rotatable eccentrics could be supported in the guide plate for this purpose. A particularly simple and reliable solution, however, is if, according to a further development of the invention, an upwardly directed, approximately U-shaped bar is arranged at the end of the slide plate adjacent the toothed locking member, which bar serves to receive a tool therebeneath, for example, the blade of a screwdriver, which is supported on the toothed locking member in the active or locked position. To release the lock, the screwdriver blade is introduced between the bar and the locking member and subsequently the handle of the screwdriver is swung upwardly so that the teeth of the toothed locking member disengage from the toothed bars on the guide rail and at the same time the shoulders of the slide plate come into frictional engagement with the projections on the guide plate. If the lock is again to be created, then the blade of the screwdriver applies a pressure onto the upper side of the bar, which brings the teeth of the locking member into engagement with the toothed bars of the guide rail.

According to a different characteristic of the invention, the slide plate has upwardly and thereafter outwardly directed angled portions defining pointers which extend through recesses in the guide plate and cooperate with scales which are arranged on the upper side of the guide plate. Through this characteristic it is possible at any time for the user to determine whether the force which is applied by one or more compression springs onto the ski boot lies within the desired area or whether it is too great or too small.

Furthermore, the guide plate inventively has a shoulder, which when the ski boot is inserted prevents the slide plate from swinging upwardly. This makes an unintended release of the lock during skiing impossible.

Furthermore, the invention provides that the support surfaces on the projections on the guide plate are inclined generally rearwardly at least over a portion of their length. Through this characteristic the upward movement of the slide plate is made easier on the one hand and on the other hand the locking operation is supported to a certain degree.

Finally, it is possible according to the invention, in order to lock the upwardly swung slide plate an unintended swinging back to the locked position thereof, to arrange a cam or a stamped bead or the like in the support surface of each of the rear shoulders of the guide plate. It is not sufficient in this embodiment to overcome during the downward swinging of the slide plate only the frictional force between the projections on the guide plate and the shoulders on the slide plate. Instead, a considerably greater downward force must be applied, which moves the slide plate against the force of the compression spring over the two cams or stampings.

BRIEF DESCRIPTION OF THE DRAWINGS

An exemplary embodiment of the subject matter of the invention is schematically illustrated in the drawings, in which.

DETAILED DESCRIPTION

Figure 1:
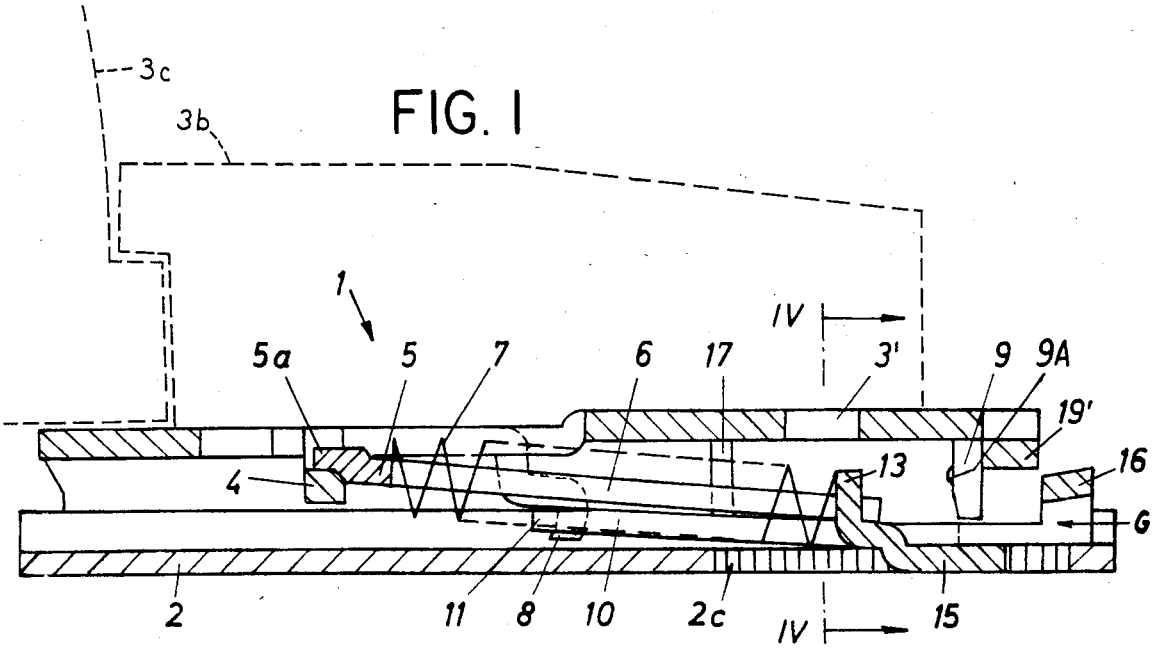
FIG. 1 is a cross sectional view taken along the line I—I of FIG. 3 of an inventive apparatus for facilitating a longitudinal adjustment of ski-binding parts, which apparatus is in the locked condition.
Figure 3:
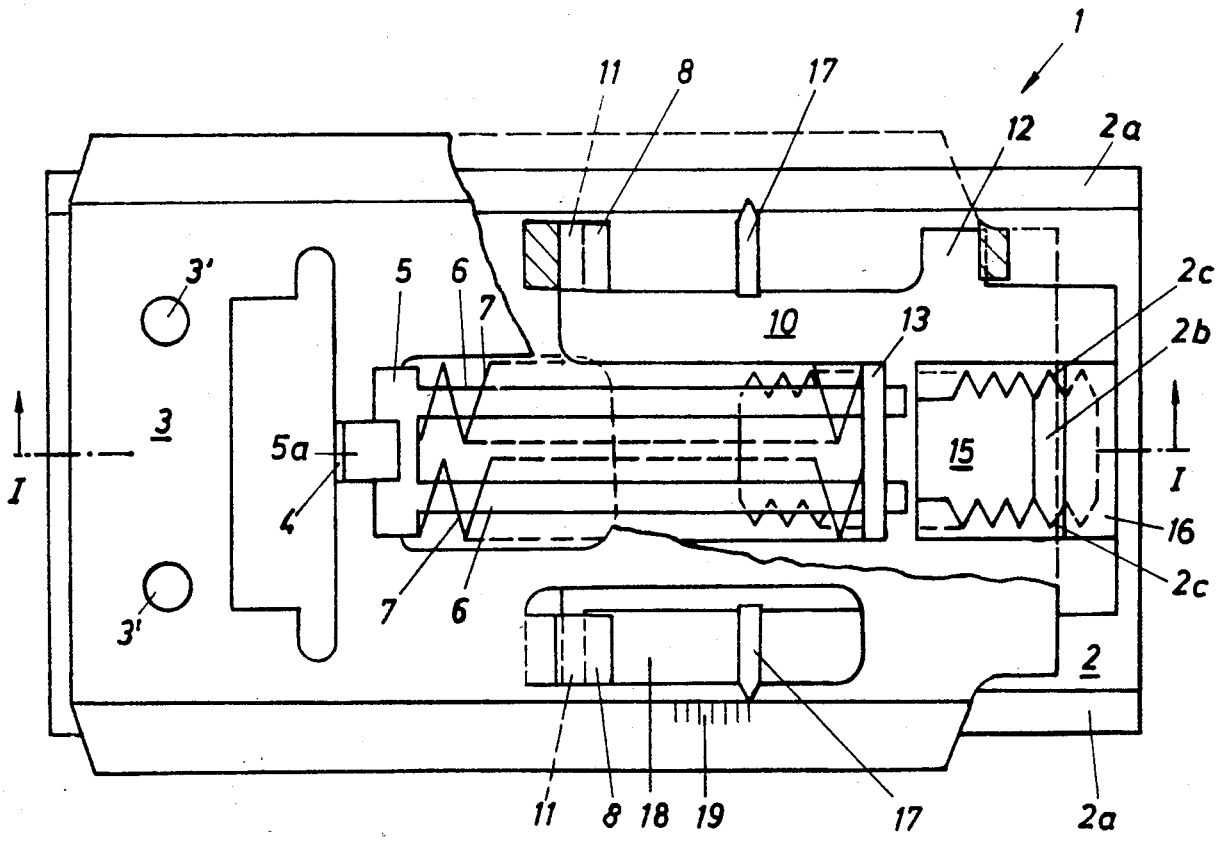
FIG. 3 is a top view of the apparatus, the guide plate being partially broken away to provide greater clarity.

The inventive apparatus 1 for facilitating a longitudinal adjustment of ski-binding parts has a guide rail 2 which is adapted to be secured to the ski and which is provided with two laterally spaced guide tracks 2*a* and has in its central region a longitudinally extending slot 2*b*, the edges of which are provided with teeth to define toothed bars 2*c*.

A guide plate 3 having lateral edge structures or flanges 3*a* which grip around the guide tracks 2*a* is movably guided on the lateral guide tracks. The guide plate 3 has in its central region a downwardly arched web 4 serving to receive a shoulder 5*a* of a crossbar 5 which extends in transverse direction of the ski. The crossbar 5 has two parallel rods 6 which extend in longitudinal direction of the ski and on which compression springs 7 are sleevably guided. The compression springs 7 serve to urge a ski-binding part 3*b* mountable on the guide plate toward a ski boot.

Furthermore, the 3*c* guide plate 3 has several holes 3' therein, which serve to receive rivets or the like (not illustrated) for facilitating a fastening of the ski-binding part 3*b* the guide plate, and a shoulder 19'. The guide plate 3 has, in the areas which are adjacent to the guide tracks 2*a* on the guide rail 2 both in the center of its longitudinal extent and also at the end which is adjacent to the toothed bars 2*c*, two sets of downwardly extending and laterally spaced projections 8 and 9. The hook-like projections 8 define a hinge joint and the projections 9 define a locking arrangement, both of which are explained in more detail below. The support surfaces of the projections 9 are slightly inclined rearwardly at least over a portion of their length. However, each or the projections can also be provided with a cam or a stamped bead or the like 9A (FIG. 1).

Figure 2:
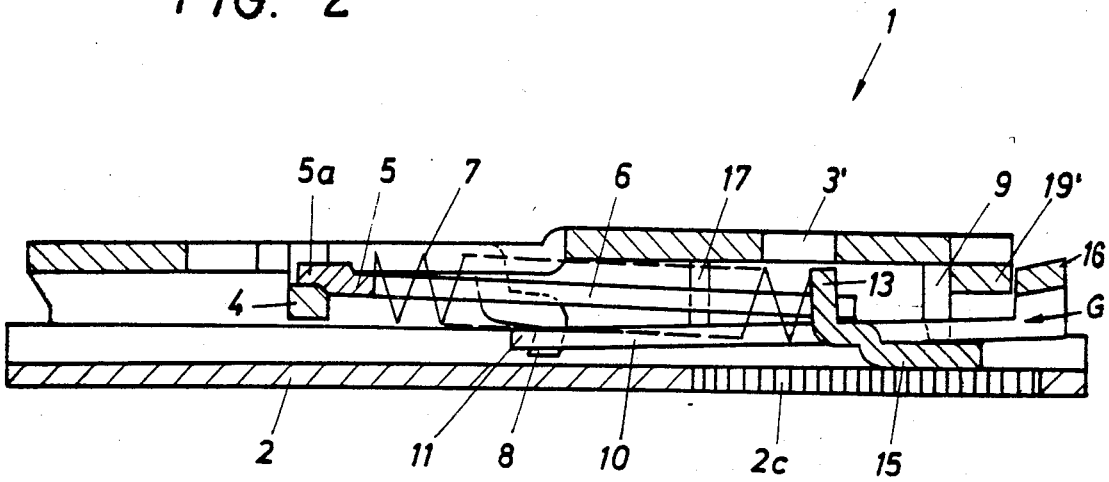
FIG. 2 illustrates the same cross sectional view of the apparatus as in FIG. 1 but with a locking part thereof in an intermediate position between its locked condition and its released condition.
Figure 4:
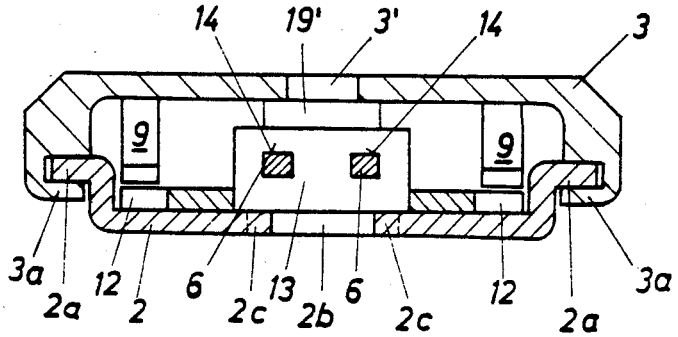
FIG. 4 is a cross sectional view taken along the line IV—IV of FIG. 1.
Figure 5:
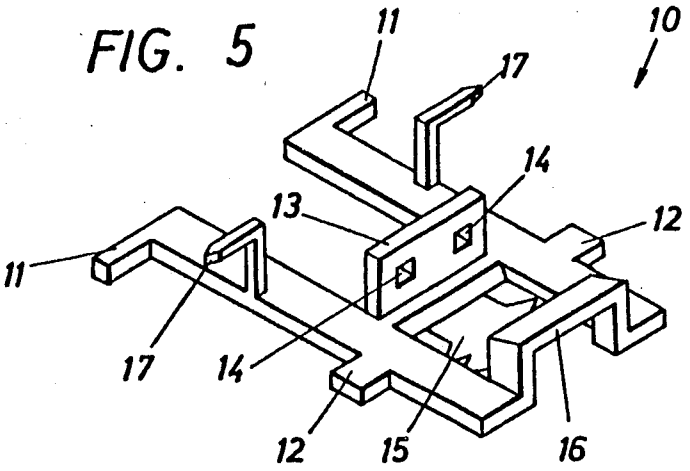
FIG. 5 illustrates a perspective view of the slide plate of the apparatus.
Figure 6:
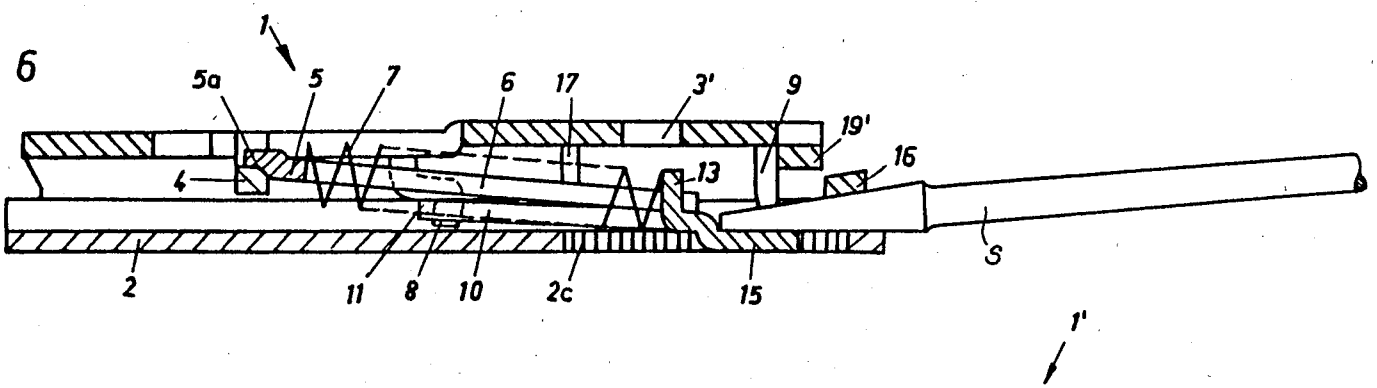
FIG. 6 illustrates a cross sectional view similar to FIG. 1 with an inserted screwdriver.

A substantially rectangular slide plate or locking part 10 (FIG. 5) is arranged between the guide rail 2 and the guide plate 3 as shown in FIGS. 1 and 2. The slide plate 10 has two pairs of laterally spaced shoulders 11 and 12. The shoulders 11 grip behind the projections 8 on the guide plate 3 to thereby define the aforementioned hinge joint between the guide plate 3 and the slide plate 10. Furthermore, the slide plate 10 has an upwardly bent portion 13 midlength thereof which provides a support for the ends of the two compression springs 7. The bent portion 13 has, in this embodiment, two holes 14 therein which movably guide therein the rods 6 of the crossbar 5 anchored in the guide plate 3. A toothed locking member 15 is provided on the slide plate 10 in the region centrally between the shoulders 12, the teeth of which are provided for engagement with the toothed bars 2*c* on the guide rail 2. The slide plate 10 has at the end thereof which is adjacent to the toothed locking member 15 an upwardly extending, approximately U-shaped bar or operating member 16, into which the blade of a screwdriver S can be introduced according to FIG. 6, the other side of which rests on the locking member 15. Finally, two indicators 17 are provided on the slide plate 10, which indicators extend through recesses 18 provided in the guide plate 3 and operatively cooperate with scales 19 which are arranged on the upper side of the guide plate in order to indicate to the user of the apparatus the force which the two compression springs 7 apply onto the ski boot which is held by the ski-binding part.

The inventive apparatus for facilitating the longitudinal adjustment of ski-binding parts operates as follows: In the engaged condition of the apparatus, the toothed locking member 15 of the slide plate 10 engages with its teeth the toothed bars 2*c* of the guide rail 2. If the ski boot is inserted into the ski binding, the guide plate 3 on which the not illustrated ski-binding part is mounted is moved back (to the right in FIGS. 1 and 2) against the force of the two compression springs 7. The two rods 6 of the crossbar, which are held on the guide plate 3, slide in the holes 14 in the upwardly bent portion 13 of the slide plate 10. The two indicators 17 indicate to the user on the scales 19 the magnitude of the force of the two compression springs 7 acting onto the ski boot. When the ski boot is inserted into the binding, the guide plate 3 will be shifted back (to the right in FIGS. 1 and 2) and the slide plate 10 will be secured against an upward swinging by the shoulder 19' on the guide plate 3.

If one discovers that the contact pressure which the ski-binding part applies onto the ski boot is too great or too small, the ski-binding part must then be adjusted in the longitudinal direction of the ski. For this purpose, the blade of the screwdrivers is introduced into the gap G between the bar 16 of the slide plate 10 and the mutually adjacent end of the locking member 15. A swinging of the bar 16 upwardly counterclockwise in FIG. 1 cause the toothed locking member 15 of the slide plate 10 to be lifted out of meshing engagement with the toothed bars 2*c* on the guide rail as shown in FIG. 2. The two shoulders 12 of the slide plate 10, due to the initial tension of the two compression springs 7, are moved into frictional contact with the projections 9 of the guide plate 3, so that the slide plate is held in the disengaged position on the guide plate. Further, it is to be noted that the springs 7 serve to keep the shoulders 11 on the slide plate into engagement with the projections 8 on the guide plate. There also exists the possibility of arranging in the support surface of each projection 9 a cam or a stamped bead or the like 9A (FIG. 1), over which the shoulder 12 of the slide plate slides during their upward swinging movement to thereby prevent an unintended swinging back of the slide plate 10 and thus a meshing locking engagement of the toothed locking member 15 with the teeth of the toothed bars 2*c*. In other words, in the uppermost or disengaged position of the locking part 10, the shoulders 12 are frictionally engaging the vertical surfaces located above the cams 9A on the projections 9. It is now possible to adjust the unit which is formed by the guide plate 3 and the slide plate 10 as desired with one hand along the guide rail 2.

If the desired position of the ski-binding part or of the unit which is formed by the guide plate 3 and the slide plate 10 is reached, it is then sufficient through a pressing down on the bar 16 of the slide plate 10, for example by means of the blade of the screwdriver, to effect a movement of the toothed locking member 15 again between the two rows of teeth on the toothed bars 2*c* of the guide rail 2. As a result, a locking engagement is again created. Only one hand is required for releasing and locking the guide plate 3.

Figure 7:
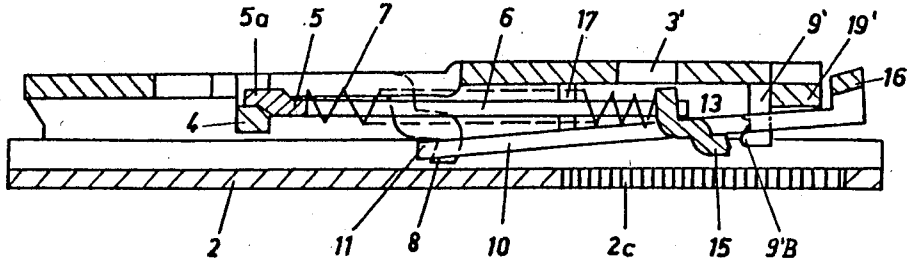
FIG. 7 illustrates an alternative embodiment to FIGS. 1 to 3 having a nose on each of the projections.

FIG. 7 illustrates an alternative solution to the locking effect between the projections 9' and the lateral shoulders 12. The projections 9' each have a nose 9'B or the like and each of the shoulders 12 is engageable with one of these noses 9'B. During the movement of the shoulders 12 on the noses 9'B of the projections 9', the whole slide plate 10 (see FIG. 2) is urged against the projections 9' due to the urging of the springs 7.

Of course the invention is by no means to be limited to the exemplary embodiment which is illustrated in the drawings and is described above. Rather, various modifications of the same are possible without departing from the scope of the invention. For example, it would be possible to manufacture the guide plate, which in the illustrated exemplary embodiment is a die-cast part, from a sheet metal blank into which, if desired, guideways of plastic are inserted.

The embodiment of the invention in which and exclusive property or privilege is claimed are defined as follows:

1. An apparatus for facilitating longitudinal adjustment on a ski of a ski-binding part which is adapted to releasably secure a ski boot on the ski, comprising: a guide rail which is adapted to be fastened to the ski, has two laterally spaced guide tracks, and has longitudinally extending toothed bars arranged between the guide tracks; a toothed locking member which can engage the toothed bars and is arranged on a slide plate, the slide plate being disposed below a guide plate which is movably supported on the guide rail, the guide plate being adapted to have the ski-binding part mounted thereon; and a compression spring which is cooperable with the slide and guide plates and urges the guide plate toward the ski boot relative to the slide plate; wherein the guide plate has in the region of its end remote from the ski boot two downwardly extending projections; wherein the slide plate is pivotally supported on the guide plate and has two shoulders at an end thereof which is adjacent the toothed locking member, the shoulders, in the released position of the apparatus, engaging the projections on the guide plate under the urging of the compression spring; and wherein for effecting the movable support of the slide plate on the guide plate, the slide plate has an upwardly bent portion having a hole therein, the hole in the upwardly bent portion of the slide plate slidably receiving a rod which is supported on the guide plate and on which is supported the compression spring.

2. An apparatus for facilitating longitudinal adjustment on a ski of a ski-binding part which is adapted to releasably secure a ski boot on the ski, comprising: a guide rail which is adapted to be fastened to the ski, has two laterally spaced guide tracks, and has longitudinally extending toothed bars arranged between the guide tracks; a toothed locking member which can engage the toothed bars and is arranged on a slide plate, the slide plate being disposed below a guide plate which is movably supported on the guide rail, the guide plate being adapted to have the ski-binding part mounted thereon; and a compression spring which is cooperable with the slide and guide plates and urges the guide plate toward the ski boot relative to slide plate; wherein the guide plate has in the region of of its end remote from the ski boot two downwardly extending projections; wherein the slide plate is pivotally supported on the guide plate and has two shoulders at an end thereof which is adjacent the toothed locking member, the shoulders, in the released position of the apparatus, engaging the projections on the guide plate under the urging of the compression spring; and wherein for effecting the pivotal support of the slide plate on the guide plate the slide plate has at its end which is remote from the toothed locking member two further laterally spaced shoulders which engaqe downwardly extending projections provided on the guide plate.

3. An apparatus for facilitating longitudinal adjustment on a ski of a ski-binding part which is adapted to releasably secure a ski boot on the ski, comprising: a guide rail which is adapted to be fastened to the ski, has two laterally spaced guide tracks, and has longitudinally extending toothed bars arranged between the guide tracks; a toothed locking member which can engage the toothed bars and is arranged on a slide plate, the slide plate being disposed below a guide plate which is movably supported on the guide rail, the guide plate being adapted to have the ski-binding part mounted thereon; and a compression spring which is cooperable with the slide and guide plates and urges the guide plate toward the ski boot relative to the slide plate; wherein the guide plate has in the region of its end remote from the ski boot two downwardly extending projections; wherein the slide plate is pivotally supported on the guide plate and has two shoulders at an end thereof which is adjacent the toothed locking member, the shoulders, in the released position of the apparatus, engaging the projections on the guide plate under the urging of the compression spring; and wherein the slide plate has bent portions which project upwardly and then outwardly and serve as indicators, said indicators extending through recesses provided in the guide plate and being associated with scales which are provided on an upper side of the guide plate.

4. An apparatus for facilitating longitudinal adjustment on a ski of a ski-binding part which is adapted to releasably secure a ski boot on the ski, comprising: a guide rail which is adapted to be fastened to the ski, has two laterally spaced guide tracks, and has longitudinally extending toothed bars arranged between the guide tracks; a toothed locking member which can engage the toothed bars and is arranged on a slide plate, the slide plate being disposed below a guide plate which is movably supported on the guide rail, the guide plate being adapted to have the ski-binding part mounted thereon; and a compression spring which is cooperable with the slide and guide plates and urges the guide plate toward the ski boot relative to the slide plate; wherein the guide plate has in the region of its end remote from the ski boot two downwardly extending projections; wherein the slide plate is pivotally supported on the guide plate and has two shoulders at an end thereof which is adjacent the toothed locking member, the shoulders, in the released position of the apparatus, engaging the projections on the guide plate under the urging of the compression spring; and wherein for securing the upwardly swung slide plate against an unintended swinging back, a support surface on each of the projections on the guide plate has thereon a cam.

5. A ski binding apparatus adapted to releasably hold a ski boot on a ski, comprising: a guide rail adapted to be fixedly mounted on the ski and having thereon a row of teeth which extends in a first direction longitudinally of the ski; a guide member supported on said guide rail for longitudinal movement therealong, said guide member being adapted to have a ski binding part mounted thereon; a locking part which has a tooth thereon; means supporting said locking part and said guide member for relative longitudinal movement, and means supporting said locking part for movement in directions which effect movement of said tooth generally transversely of said first direction between first and second positions in which said tooth is respectively engaging and spaced from said row of teeth on said guide rail; resilient means for yieldably urging longitudinal movement of said locking part in said first direction relative to said guide member; limit means for limiting movement of said locking member in said first direction under the urging of said resilient means; means for causing said locking part to be resiliently urged from said second to said first position; and holding means cooperable with said locking part when it is in said second position for releasably holding said locking part against movement toward said first position, wherein when said locking part is released from said holding means said locking part is moved to its first position by said means which resiliently urges said locking part toward said first position.

6. The apparatus according to claim 5, wherein said means for releasably holding said locking part in said second position includes said locking part and said guide member respectively having first and second surfaces thereon which respectively face in said first direction and in a second direction opposite said first direction, said first and second surfaces slidably engaging each other and being free of engagement when said locking part is respectively in said second and first positions, wherein when said locking part is in said second position, said resilient means urges said first surface against said second surface so as to produce friction therebetween which resists movement of said locking part toward said first, position thereof.

7. The apparatus according to claim 6, wherein said second surface has thereon a cam over which said locking part must slide as it moves from said second position to said first position.

8. The apparatus according to claim 6, wherein said tooth moves generally vertically between its first and second positions; and wherein said means for releasably holding said locking part in said second position includes said guide member having two laterally spaced first projections which extend downwardly from an underside thereof, each said first projection having a said second surface thereon, and includes said locking part being provided below said guide member and having laterally outwardly projecting first shoulders on opposite sides thereof which each have a said first surface thereon, said first surface on each said first shoulder slidably engaging said second surface on a respective said first projection when said locking part is in said second position.

9. The apparatus according to claim 8, wherein said second surface on each said first projection includes a cam which projects in said second direction and over which said first surfaces on said first shoulders of said locking part must slide during movement of said locking part from said second position to said first position.

10. The apparatus according to claim 8, wherein said second surface on each said first projection merges at its lower end into a further surface which is inclined downardly and in said first direction.

11. The apparatus according to claim 8, wherein said limit means includes said guide member having two laterally spaced second projections which extend downwardly from said underside thereof at locations spaced in said second direction from said first projections, and includes two second shoulders which project laterally outwardly from opposite sides of said locking part, relative movement of said locking part and said guide member under the urging of said resilient means causing said second shoulders to move into engagement with said second projections, and engagement of said second shoulders and said second projections preventing further movement of said locking part relative to said guide member in said first direction; and wherein said means movably supporting said locking part includes said locking part being pivotal about a transverse horizontal first axis substantially coincident with the region of engagement of said second shoulders and said second projections when said second shoulders are engaging said second projections, said tooth and said first shoulders on said locking part being spaced radially from said first axis.

12. The apparatus according to claim 11, wherein said locking part has an upwardly extending portion, said upwardly extending portion having means defining two laterally spaced openings which extend therethrough approximately in said first direction; wherein said means supporting said locking part includes a cross part which is supported on said underside of said guide member for pivotal movement about a transversely extending, horizontal second axis, and includes two elongate, laterally spaced rods which each have one end fixedly secured to said cross part and which each extend away from said cross part approximately in said first direction, each said opening in said portion of said locking part slidably receiving a respective said rod; and wherein said resilient means includes two helical compression springs which extend between and have their ends supported on said cross part and said portion of said locking part and which each encircle a respective said rod.

13. The apparatus according to claim 12, including means defining an opening through said guide member, means defining a scale on said guide member adjacent said opening, and an indicator which is fixedly secured on said locking part and projects upwardly through said opening in said guide member, the position of said indicator relative to said scale when a ski boot is releasably held in said ski binding part providing a visual indication of the force being exerted onto the ski boot in said second direction by said resilient means.

14. The apparatus according to claim 13, including means defining an upwardly projecting, substantially U-shaped operating member at an end of said locking part remote from said second shoulder.

15. The apparatus claim 14, wherein said locking part includes a plate having said second shoulders and said U-shaped operating member at opposite ends thereof, said upright portion being an upwardly bent portion of said plate located between said ends thereof, and said first shoulders and said tooth being located in the region of said upright portion.

* * * * *